United States Patent [19]

Sugisawa et al.

[11] Patent Number: 4,637,145

[45] Date of Patent: Jan. 20, 1987

[54] LOW PRESSURE MICROWAVE DRYING APPARATUS

[75] Inventors: Ko Sugisawa; Yasushi Matsumura, both of Nara; Kazumitsu Taga, Neyagawa; Ryuichi Hattori, Kyoto, all of Japan

[73] Assignee: House Food Industrial Company Ltd., Osaka, Japan

[21] Appl. No.: 554,861

[22] Filed: Nov. 23, 1983

[30] Foreign Application Priority Data

Nov. 24, 1982 [JP] Japan ..... 57-177993[U]

[51] Int. Cl.[4] ..... F26B 23/08

[52] U.S. Cl. ..... 34/1; 34/92; 219/10.55 A; 219/10.55 R

[58] Field of Search ..... 34/1, 92; 219/10.55 A, 219/10.55 R

[56] References Cited

U.S. PATENT DOCUMENTS

| | | | |
|---|---|---|---|
| 3,986,268 | 10/1976 | Koppelmann | 34/1 |
| 4,045,639 | 8/1977 | Meisel | 219/10.55 A |
| 4,204,336 | 5/1980 | Le Viet | 34/1 |
| 4,208,806 | 6/1980 | Manser et al. | 34/1 |
| 4,330,946 | 5/1982 | Courneya | 34/1 |
| 4,347,670 | 9/1982 | Wear et al. | 34/92 |
| 4,430,806 | 2/1984 | Hopkins | 34/1 |

*Primary Examiner*—Albert J. Makay
*Assistant Examiner*—David W. Westphal
*Attorney, Agent, or Firm*—Harry M. Weiss & Associates

[57] ABSTRACT

An improved low pressure microwave drying apparatus comprises a drying chamber made of a microwave-permeable and gas-impermeable material and a microwave applying chamber made of a microwave-impermeable material which encloses the drying chamber at a distance therefrom. The drying chamber is provided with a gas exhaust system and the microwave applying chamber with a microwave generator.

8 Claims, 2 Drawing Figures

LOW PRESSURE MICROWAVE DRYING APPARATUS

BACKGROUND OF THE INVENTION

The present invention relates to an improved low pressure microwave drying apparatus, more particularly to a low pressure microwave drying apparatus free from the occurrence of the glow discharge phenomenon.

The low pressure microwave drying apparatus is known as a means for drying a substance by irradiating it with microwaves under conditions which restrict the rise of the temperature therein. However, in the case where a substance is dried by the conventional low pressure microwave drying apparatus, the glow discharge may occur during the irradiation of microwaves, depending on the degree of pressure reduction. If glow discharge occurs during the drying procedure, this causes various disadvantages, among which can be mentioned detrimental effects on the substance to be dried such as chemical change of its constituents and partial overheating, harmful effects on the drying apparatus itself such as damage to the magnetron, and loss of microwave energy.

SUMMARY OF THE INVENTION

The inventors studied ways to overcome the above mentioned disadvantages of the conventional low pressure microwave drying apparatus and as a result found that the disadvantages can be effectively overcome by dividing the microwave drying apparatus into two compartments, i.e., a microwave applying region and a drying region. On the basis of this knowledge they completed the present invention.

The purpose of the invention is to provide an improved low pressure microwave drying apparatus free from the occurrence of glow discharge during the drying operation, which enables elimination of the disadvantages of the prior art, namely of detrimental effects on the substance to be treated such as chemical change and partial overheating, harmful effects on the drying apparatus itself such as damage to the magnetron, loss of the microwave energy, and the like.

DETAILED EXPLANATION OF THE INVENTION

The improved low pressure microwave drying apparatus according to the invention comprises a drying chamber made from a microwave-permeable and gas-impermeable material and a microwave applying chamber made of a microwave-impermeable material, which latter chamber encloses the drying chamber at a distance therefrom. The drying chamber is provided with a gas exhaust system and the microwave applying chamber with a microwave generator.

Thus, according to the drying apparatus of this invention, the occurrence of glow discharge can be effectively prevented by dividing the drying apparatus into two compartments. As the microwave-permeable and gas-impermeable material used in the present invention, there can be mentioned, for example, Teflon (prepared by E. I. du Pont de Nemours & Co., Inc.) quartz, ceramics, polystyrene, glass fibre and carbon fibre.

While, as microwave-impermeable material for fabricating the microwave applying chamber, aluminium, stainless steel, light alloy and duralumin may be used.

Among these, aluminum and stainless steel are preferred.

While, as the gas exhaust system and the microwave generator, any one of the conventional devices may be used in the present invention.

A preferred embodiment of the drying apparatus according to the invention, given by way of non-limitative example only, is now described with reference to the accompanying drawings.

Figure 1:
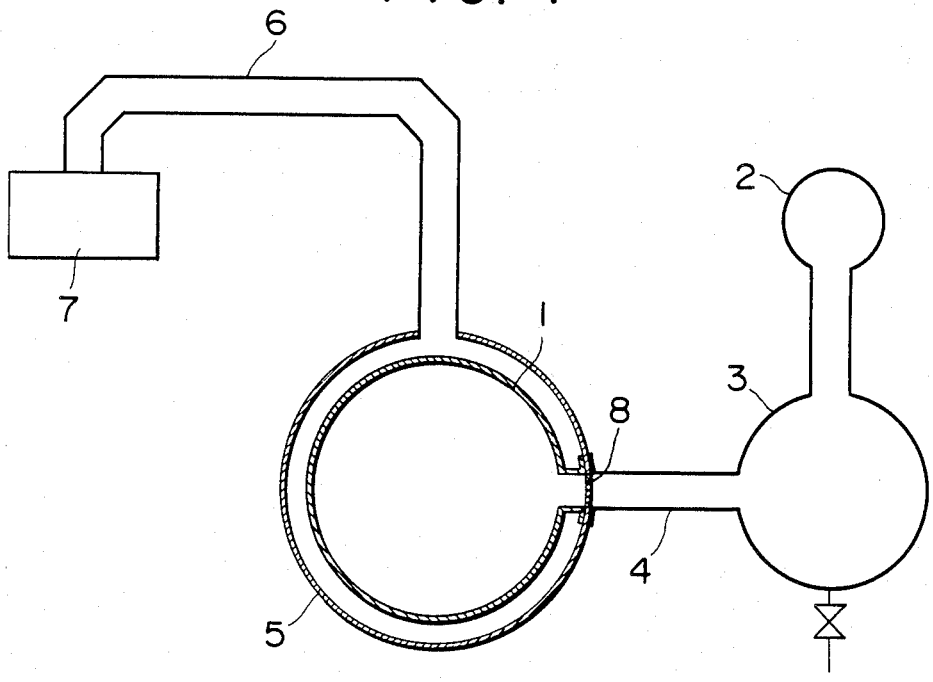
FIG. 1 is a schematic drawing of an embodiment of the drying apparatus according to the invention.
Figure 2:
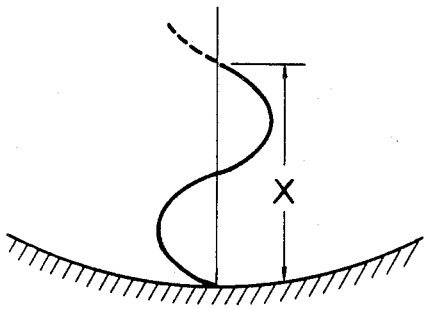
FIG. 2 is a diagram which shows the power density of microwaves.

Now referring to FIG. 1, the reference number 1 denotes a drying chamber in which a substance to be treated is dried. It is important that the drying chamber 1 is made of microwave-permeable and gas-impermeable material. A vacuum pump 2 for reducing the pressure in the drying chamber 1 is connected to the drying chamber 1 through an exhaust pipe 4 to a cold trap 3 for removing moisture from the drying chamber 1.

The drying chamber 1 is provided with a microwave applying chamber 5 made of a microwave-impermeable material, which encloses the chamber 1 spaced a distance apart therefrom. The microwave applying apparatus is provided with a microwave oscillator 7 connected therewith by a waveguide 6.

In the embodiment disclosed in FIG. 1, the exhaust pipe 4 which connects the drying chamber 1 with the cold trap 3 passes through the wall of the microwave applying chamber 5. A material between the chamber 1 and the chamber 5 may be the same as the material of the chamber 1, and the part of the wall of the chamber 5 falling within the pipe 4 is constituted by a panting plate 8 which is permeable to gases but impermeable to microwaves.

As further illustrated in FIG. 3, the exhaust pipe 4 is preferably operably coupled thereto to a steam ejector 10 which in turn is operably coupled to a water sealable pump 9.

A distance between the wall of the chamber 5 and the wall of the chamber 1 is not critical. However, microwaves of wavelength generally show maximum power density at a distances of $(2n-1)/4\cdot\lambda$ from a microwave reflecting plate and a minimum density at distances of $n/2\cdot\lambda$ therefrom. ($n$=a natural number, $\lambda$=wavelength)

Therefore, it is preferable to determine the width of the microwave applying chamber 5 in the radial direction by taking this property of microwaves into consideration. For example, if it is intended to prevent moisture condensation on the inner wall of the drying chamber 1 during the drying operation, it is preferred to choose a distance of $(2n-1)/4\cdot\lambda$ at which the power density of the microwaves is the highest, as the width of the microwave applying chamber. In this case, the drying chamber 1 is heated by the irradiation of microwaves and the moisture condensation on the wall of the drying chamber 1 can be prevented. While, if it is intended to reduce the microwave energy loss as much as possible during the drying operation, the distance of the microwave applying chamber 5 is preferable on the order of $\frac{1}{2}\lambda$ or $\lambda$, at which the power density is the lowest. In this case, almost all of the microwave energy can be utilized to dry the substance without loss of the microwave energy due to absorption by the drying chamber 1.

For example, the wavelength of a 2450 MHz microwave is 12 cm. Therefore, to prevent moisture condensation in the drying chamber 1 when using such a microwave, the distance of the microwave applying chamber should be $\frac{1}{4}\lambda$ or $\frac{3}{4}\lambda$, i.e., on the order of about 3 cm or 9 cm, while to minimize the loss of microwave energy, said distance should be $\frac{1}{2}\lambda$ or $\lambda$, i.e., on the order of about 6 cm or 12 cm.

The drying apparatus according to the invention is constructed as described above. However, in the above-mentioned gas exhaust system, as shown in FIG. 3, it is also possible to use a water sealable vacuum pump 9 and a steam ejector 10, and thus to eliminate a provision for a cold trap.

The function and effect of the apparatus of this invention will now be explained with reference to FIG. 1.

In operating the apparatus according to the invention, the cold trap 3 is firstly cooled and then the substance to be dried is introduced into the drying chamber 1. Thereafter, the pressure in the chamber 1 is reduced to a desired degree of vacuum by operating the vacuum pump 2. Thus, it is possible to establish the desired degree of vacuum in the drying chamber 1 since the wall of the drying chamber is made of a microwave-permeable and gas-impermeable material and further the microwaves may easily be introduced into the drying chamber 1. Then, by starting up the microwave oscillator 7, microwaves are introduced into the microwave applying chamber 5 through the waveguide 6. Since the wall of the microwave applying chamber 5 is microwave-impermeable, the microwave introduced into the microwave applying chamber 5 do not leak from the wall of the chamber 5. The microwaves introduced into the chamber 5 are readily transmitted to the drying chamber 1 through the microwave-permeable wall between the chambers 1 and 5 to dry the substance to be treated.

Thus, the microwaves are firstly introduced into the chamber 5 which is maintained at normal pressure and then transmitted to the drying chamber 1 in which the pressure has been adjusted to a desired degree of vacuum. Therefore, according to the invention, it is possible to prevent the occurrence of glow discharge, which cannot be prevented in the conventional low pressure microwave drying apparatus.

It is clear from the above description that according to the drying apparatus of this invention, the glow discharge which occurs upon application of microwaves in vacuums can be effectively prevented. As a result, it is also possible to prevent the occurrence of various disadvantages due to glow discharge, namely detrimental effects such as chemical change and partial overheating of the substance being treated, harmful effects on the low pressure microwave drying apparatus itself such as damage to the magnetron, loss of microwave energy, and the like.

While the invention has been particularly shown and described in reference to the preferred embodiments thereof, it will be understood by those skilled in the art that changes in form and details may be made without departing from the spirit and scope of the invention.

We claim:

1. A low pressure microwave drying apparatus which comprises a microwave-permeable and gas-impermeable drying chamber for drying a substance to be treated and a microwave-impermeable microwave applying chamber which encloses the drying chamber at a distance therefrom, the drying chamber being provided with a gas exhaust system and the microwave applying chamber being provided with a microwave generator, whereby a material being dried is subjected to a partial vacuum and the microwave generator operates at ambient pressure.

2. A low pressure microwave drying apparatus as set forth in claim 1 wherein said microwave-permeable and gas-impermeable drying chamber is one of a Teflon material, quartz material and ceramics material.

3. A low pressure microwave drying apparatus as set forth in claim 1 or 2 in which said gas exhaust system is at least one of a water sealable vacuum pump and a steam ejector.

4. A low pressure microwave drying apparatus as set forth in claim 1 wherein the drying apparatus is further provided with a panting plate in an exhaust pipe at the wall of the microwave applying chamber.

5. A low pressure microwave drying apparatus as set forth in any of claims 1, 2 or 4 wherein a distance between said drying chamber and said microwave and said microwave applying chamber is equal to $(2n-1)/4\cdot\lambda$ of the wavelength of the microwave used, said n equals a natural number and $\lambda$ equals a wavelength.

6. A low pressure microwave drying apparatus as set forth in claim 3 wherein a distance between said drying chamber and said microwave applying chamber is equal to $(2n-1)/4\cdot\lambda$ of the wavelength of the microwave used, said n equals a natural number and $\lambda$ equals a wavelength.

7. A low pressure microwave drying apparatus as set forth in any claims 1, 2 or 4 wherein a distance between said drying chamber and said microwave applying chamber is equal to $n/2\cdot\lambda$ of the wavelength of the microwave used, said n equals a natural number and $\lambda$ equals a wavelength.

8. A low pressure microwave drying apparatus as set forth in claim 3 wherein a distance between said drying chamber and said microwave applying chamber is equal to $n/2\cdot\lambda$ of the wavelength of the microwave used, said n equals a natural number and $\lambda$ equals a wavelength.

* * * * *